United States Patent [19]

Humphrey

[11] 4,308,758

[45] Jan. 5, 1982

[54] DRIVE BOX

[76] Inventor: C. Thomas Humphrey, 5589 Regent St., Burnaby, British Columbia, V5B 4R6, Canada

[21] Appl. No.: 133,307

[22] Filed: Mar. 24, 1980

[30] Foreign Application Priority Data

Mar. 28, 1979 [CA] Canada ..... 324331

[51] Int. Cl.[3] ..... F16H 33/00; F16H 33/10

[52] U.S. Cl. ..... 74/87; 74/61

[58] Field of Search ..... 74/61, 87

[56] References Cited

U.S. PATENT DOCUMENTS

| | | | |
|---|---|---|---|
| 2,065,798 | 12/1936 | Dempsey et al. | 74/61 |
| 2,505,753 | 5/1950 | Cleveland | 74/87 |
| 2,865,210 | 12/1958 | Fisher | 74/61 |
| 2,902,868 | 9/1959 | Ferrara | 74/61 |
| 3,221,567 | 12/1965 | Brandt | 74/61 X |
| 3,224,514 | 12/1965 | Hornstein et al. | 74/61 X |
| 3,468,418 | 9/1969 | Renner | 74/61 X |

FOREIGN PATENT DOCUMENTS

| | | | |
|---|---|---|---|
| 1319115 | 6/1973 | United Kingdom | 74/61 |

*Primary Examiner*—Lawrence J. Staab

*Attorney, Agent, or Firm*—Cushman, Darby & Cushman

[57] ABSTRACT

A drive unit for vibrating machines such as shakers or vibrating screens includes a box structure enclosing a fixed shaft having an eccentrically positioned rotor thereon. The distance of the rotor from the shaft can be varied thereby varying the amount of throw. The box structure may be mounted either vertically or horizontally to effect either vertical or horizontal motion to the device to be vibrated. The position of the box can be varied between horizontal and vertical to provide a combined motion to the driven machine.

1 Claim, 3 Drawing Figures

DRIVE BOX

This invention relates to vibrating machines and in particular to a drive unit for vibrating machines such as shakers, vibrating screens, and processing machines.

Conventionally, drive units for vibrating machines use a live shaft mounted in upper and lower bearings with a further bearing mounting an eccentric rotor thereon. Rotation of the rotor and shaft imparts vibratory movement to the device to which the rotor is attached.

The present invention provides novel improvements over prior art devices by providing a drive unit using a fixed shaft with a single bearing thereon, variable throw speed and a variable direction of vibration to the device to be driven.

In accordance with a broad aspect, the invention relates to a device unit for a vibrating machine comprising a box structure having top and bottom walls and side walls; a shaft fixed between said top and bottom walls; a bearing assembly on said fixed shaft mounted for rotation by drive means; an eccentrically positioned rotor mounted on the exterior of said bearing assembly whereby rotation of said rotor on the shaft imparts movement to said box structure; said box structure being adapted for variable angular positioning on a machine to be driven, from vertical through to horizontal.

The invention is illustrated by way of example in the accompanying drawings in which.

Figure 1:
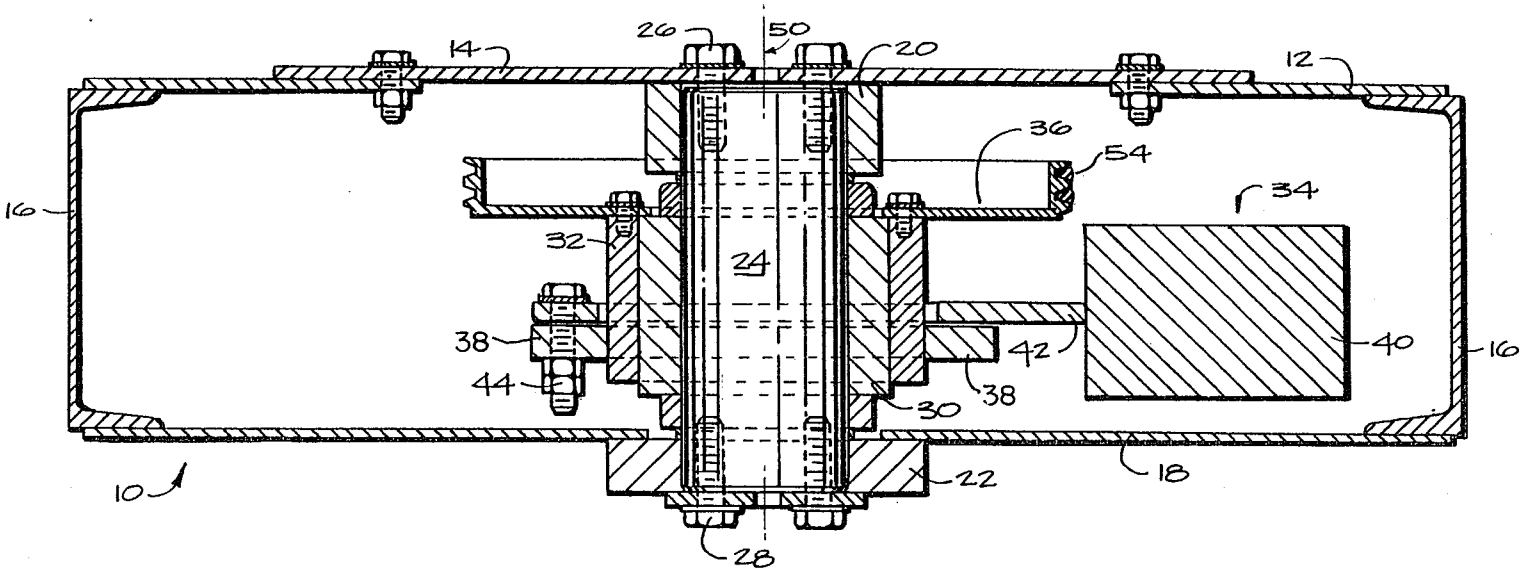
FIG. 1 is a cross-sectional view of the drive unit.

Referring to FIG. 1, the drive unit 10 of this invention includes a rigid box structure 12 having a top wall 14, end walls 16 and a bottom wall 18. The top wall 14 includes an integral hub 20 and bottom wall 18 includes an integral hub 22, both hubs being in alignment for structurally supporting a shaft 24 of substantial diameter by means of upper and lower bolts 26,28 respectively.

A bearing assembly 30 is mounted for rotation on the shaft 24 and includes an outer rotatable housing 32 for supporting a rotor 34 and, in the illustrated example, a drive pulley 36. Rotor 34 includes a flange 38 welded to the housing 32 and a weight 40 eccentrically mounted from the shaft 24 by means of a plate 42 bolted to the flange 38 at 44. While not illustrated, weight 40 can be positioned at varying distances from the bearing housing 32 to increase or decrease the amplitude of vibration applied to the driven device.

Figure 2:
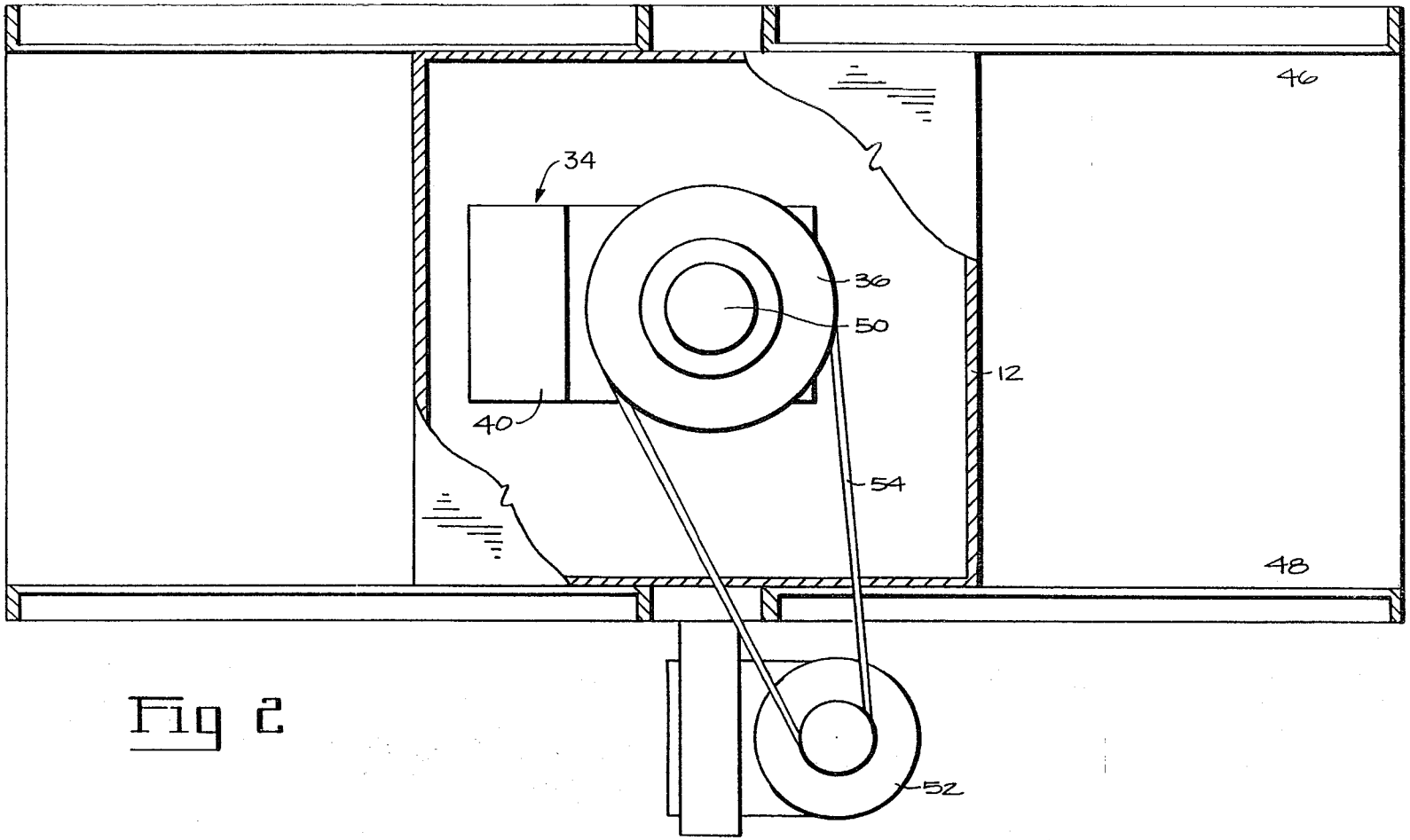
FIG. 2 is a side view of the drive unit mounted for imparting vertical motion.
Figure 3:
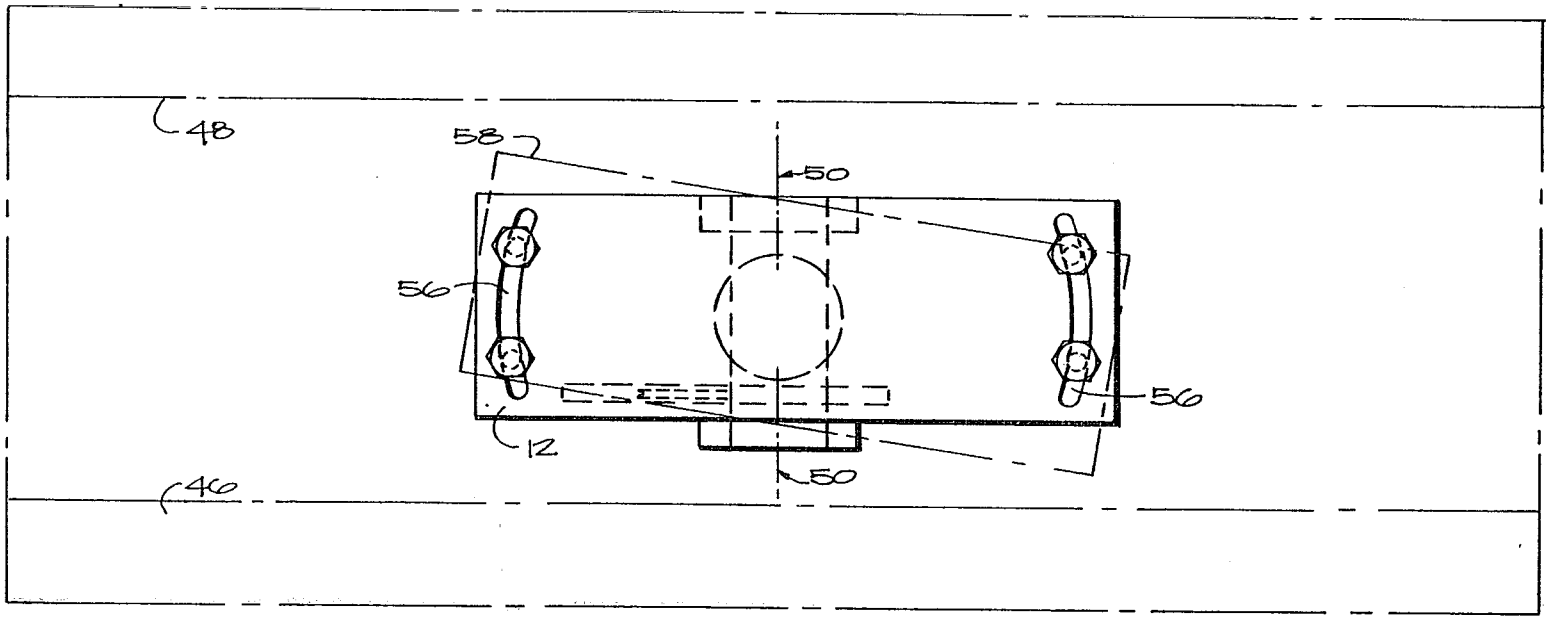
FIG. 3 is an end elevation of the drive unit.

The drive box 12 may be mounted above, below or between a driven device such as screen decks 46, 48 as shown in FIG. 3 with the axis of rotation 50 being vertical to impart a horizontal movement of the screens 46,48 or, as shown in FIG. 2, the box 12 can be secured between the screens with the axis 50 on a horizontal plane to impart vertical movement to the screens or other driven members. FIG. 2 shows one form of drive means for the rotor 34 in the form of an electric motor 52 secured to the exterior of the screens and connected to the rotor pulley 36 by drive belts 54. Other forms of drive may be advantageously used such as an hydraulic motor mounted within the box 12.

A combination vertical-horizontal movement may be applied to the driven device as shown in FIG. 3 where the side walls 16 of the box 12 are provided with arcuate slots 56 by means of which the box 12 may be angularly mounted to the deck structure as indicated by the phantom line 58.

It will be appreciated that the drive box of the present invention provides a substantial improvement over known drive boxes in that the use of a single, dead shaft with a single bearing housing therearound provides a box with no bearing alignment problems. Additionally, only half as many bearings are used in comparison with known boxes and the compact design allows a much smaller box, a factor that can be critical in some applications.

While the present invention has been described in connection with a specific embodiment thereof and in a specific use, various modifications to the drive box will occur to those skilled in the art without departing from the spirit and scope of the invention as set forth in the appended claims.

The terms and expressions which have been employed in this specification are used as terms of description and not of limitation and there is no intention in the use of such terms and expressions to exclude any equivalents of the features shown and described or portions thereof, but it is recognized that various modifications are possible within the scope of the invention claimed.

I claim:

1. A drive unit for a vibrating machine such as a shaker or the like comprising a box structure having top, bottom and side walls;

said top and bottom walls having aligned hub members mounted securely thereto;

a dead shaft of substantial diameter secured to and supported by said hub members;

a bearing assembly mounted on the exterior of said shaft for rotation thereon, said bearing assembly including a housing secured to its exterior;

said dead shaft, bearing and housing being concentrically arranged with respect to one another;

one end surface of said housing having a driven pulley concentrically mounted thereto;

a flange secured to said housing adjacent its other end surface;

and a rotor assembly detachably mounted to said flange; said rotor assembly including a weight thereon positioned eccentrically with respect to the bearing and dead shaft whereby rotation of the housing and bearing effects vibratory movement to the drive unit; and drive means mounted on the exterior of the box for rotating said driven pulley by belts or the like.

* * * * *